US006075959A

United States Patent [19]

Jeyadev et al.

[11] Patent Number: 6,075,959

[45] Date of Patent: Jun. 13, 2000

[54] DISCHARGE OF PHOTORECEPTORS

[75] Inventors: Surendar Jeyadev, Rochester; Merlin E. Scharfe, Penfield; James M. Markovics, Rochester; Damodar M. Pai, Fairport, all of N.Y.

[73] Assignee: Xerox Corporation, Stamford, Conn.

[21] Appl. No.: 09/216,053

[22] Filed: Dec. 18, 1998

[51] Int. Cl.[7] ..... G03G 15/00

[52] U.S. Cl. ..... 399/127; 399/128; 399/177

[58] Field of Search ..... 399/127, 128, 399/177, 182

*Primary Examiner*—William Royer
*Assistant Examiner*—William A. Noe

[57] ABSTRACT

An electrophotographic printing machine has a photoreceptive member. The photoreceptive member is charged and then exposed with a light image representation to form a latent image. An electric field, less than that required to re-charge the photoreceptive member, is applied to the latent image to increase the rate of discharge of the exposed portions of the latent image. The latent image is then developed.

11 Claims, 2 Drawing Sheets

DISCHARGE OF PHOTORECEPTORS

FIELD OF THE INVENTION

This invention relates to electrophotographic printing machines and more particularly to the selective discharge of the photoreceptive member of an electrophotographic printing machine between the exposure and development station.

BACKGROUND OF THE INVENTION

Electrophotographic marking is a well-known and commonly used method of copying or printing documents. Electrophotographic marking is performed by exposing a light image representation of a desired document onto a substantially uniformly charged photoreceptive member. In response to exposure by the light image representation, the photoreceptive member discharges so as to create an electrostatic latent image of the desired document on the surface of the photoreceptive member. The development material, having toner, is then deposited onto the electrostatic latent image so as to form a toner image. The toner image is then transferred from the photoreceptor onto a substrate such as a sheet of paper. The transferred toner image is then fused to the substrate to form the completed document. Fusing of the toner image to the substrate is typically accomplished by a combination of heat and/or pressure. The surface of the photoreceptive member is then cleaned of residual developing material and recharged in preparation for production of another document.

Electrophotographic printing machines can employ discharge area development to develop the exposed latent image. In discharge area development (DAD) the charged photoreceptive member is exposed where the marking material is to appear on the final document. The marking material of toner is developed into the discharged area to form the image for transfer to a substrate. The discharge of the photoreceptive member occurs over time whereby the exposed portions of the photoreceptive member have a voltage varying over time to define a discharge curve. The print quality of an electrophotographic printing machine employing DAD is dependent on the voltage of the exposed portions of the photoreceptive member extending sufficiently far into the tail of the discharge curve. In other words, the image area must be sufficiently discharged for sufficient development and thereby acceptable image quality. This is achieved by the extension of the voltage of the exposed portions of the photoreceptive member sufficiently far into the discharge curve thereby providing adequate contrast potential in the latent image. In addition, extension of the voltage at the exposed portions sufficiently far into the discharge curve predicts the surface voltage of the photoreceptive member at the development station within preselected voltages. These preselected voltages are preferred for acceptable print quality. The sufficient extension of the voltage at the exposed portions into the tail of the discharge curve requires adequate time to be provided for the photo-generated carriers in the photoreceptive member to be injected into and then transit the transport layer of the photoreceptive member. Typically however, in digital imaging systems whereby exposure is accomplished by a laser, charges amounting to a CV's worth are generated in the photoreceptor as a result of the substantial quantity of charge generated by exposure with a laser.

Electrophotographic printing machines are therefore designed to provide sufficient time for the majority of the photo-generated carriers to transit the transport layer of the photoreceptive member prior to the latent image arriving at the development station. The provision of sufficient time for transit of the photo-generated carriers through the transport layer allows for maximum contrast of voltage potentials in the exposed and unexposed portions of the latent image. In addition, the provision of sufficient time for charge transit results in stable print quality as the potential on the surface of the photoreceptive member does not rapidly change in time. However, particularly with the color systems, having narrow tolerances required for high quality color hardcopies using digital exposure systems, the effect of charge transit time limitations can impose architectural limitations on the electrophotographic printing machine.

SUMMARY OF THE INVENTION

Briefly stated, the invention is an electrophotographic printing machine and method of operation thereof having a photoreceptive member, an exposure station, and a developer station. A field generating apparatus is positioned between the exposure station and development station for applying an electric field to the latent image on the photoreceptive member. The applied electric field increases the discharge rate and therefore decreases the time for discharge of the photoreceptive member below a particular level.

Laser raster output scanners (ROS) or LED arrays in the exposure station typically produce close to a CV's worth of charge. In color systems the laser ROS or LED arrays are employed to form the halftone dots of the latent image representation. The field as a result of the CV's worth of charge applied to the photoreceptive member is typically equal to the applied field resulting from the surface charge on the photoreceptor. Therefore the charges in the vicinity of the trailing edge of the charge front experience very low electric fields. These low fields result in the time required for these trailing charges to transit the photoreceptor to be relatively long. As a result, the discharge process is not sufficiently completed at the time the exposed portions of the photoreceptive member arrive at the development station. The desired degree of discharge of the exposed portions of the photoreceptive member for particular electrophotographic machines depends on the process tolerances and controls.

Continuing discharge at the time of development can result in unacceptable color shifts and therefore deteriorated print quality. These resulting print quality defects are particularly damaging in color electrophotographic printing machines. One solution is to increase the transit time of the latent image between the exposure stations and the development station. This can be accomplished by either reducing the process rate of the electrophotographic printing machine or physically positioning the exposure and development stations farther apart. However, typically, process speed limitations and architectural space limitations limit the amount of process time that can occur between the exposure stations and the development stations. Application of an external field to the latent image between the exposure station and the development station increases the rate of discharge of the photoreceptive member. The increased rate of discharge thereby completes discharge of the photoreceptive member below a preselected level at the time of arrival of the latent image at the development station.

In one embodiment of an electrophotographic printing machine in accordance with the invention, an electrode is positioned in close relationship to the surface of the photoreceptive member. A voltage is applied to the electrode to generate an electric field in the photoreceptive member. This field increases the discharge rate in the photoreceptive member. The field is pre-selected to be below the critical level that would recharge the photoreceptive member and deteriorate or destroy the latent image.

An alternative embodiment of an electrophotographic printing machine in accordance with the invention has a biased roller contacting the photoreceptive member between the exposure station and the development station. A pre-established bias is applied to the roller. The pre-established bias on the bias roller is also pre-selected to be below the critical voltage so as not to re-charge the photoreceptor and deteriorate or destroy the latent image.

DETAILED DESCRIPTION OF A PREFERRED EMBODIMENT OF THE INVENTION

Figure 1:
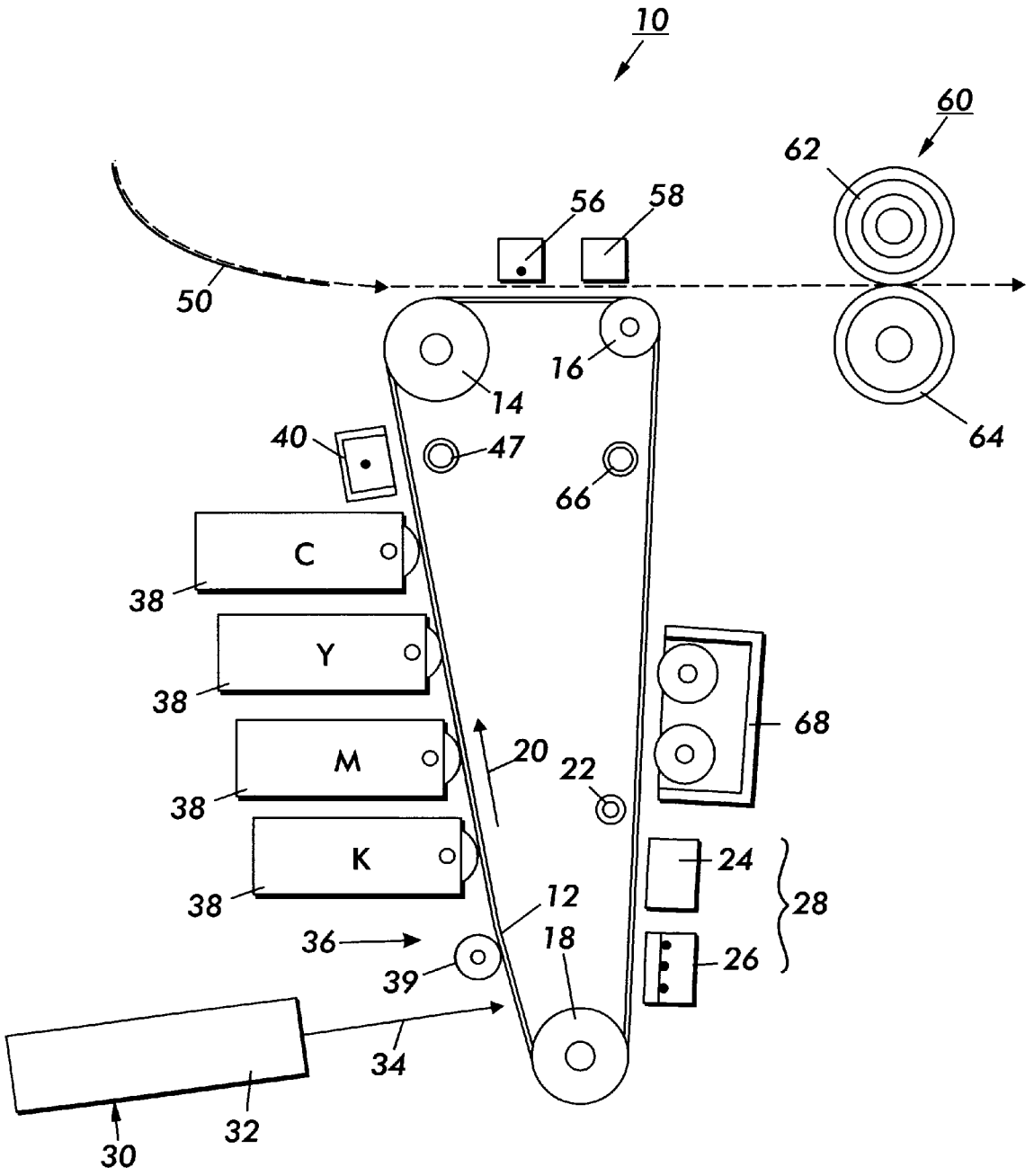
FIG. 1 is a schematic side-view of an electrophotographic printing machine in accordance with the invention.

With reference to FIG. 1, an electrophotographic printing machine in accordance with the invention preferably operates to produce a composite color image on a substrate. The electrophotographic printing machine 10 has a photoreceptive member 12 formed of an active matrix photoreceptor layer (AMAT) or alternatively formed of a photoreceptive drum or other well-known structures. The photoreceptive member 12 is driven around a cyclical path or loop on first and second tension rollers 16, 18 by a drive roller 14. The photoreceptive member 12 moves in a closed cyclical path having a process direction indicated by the arrow 20. For purposes of discussion a single section of the photoreceptive member 12 is identified as the image area. The image area is that part of the photoreceptive member 12 which receives the various processes by the stations positioned around the photoreceptive member 12. The photoreceptive member 12 may have numerous image areas; however, each image area is processed in the same way.

The production of a color document by the electrophotographic printing machine 10 takes place in preferably four cycles or rotations of the photoreceptive member 12. The first cycle begins with the image area of the photoreceptive member 12 moving in the process direction past a pre-charge erase lamp 22. The pre-charge erase lamp 22 illuminates the image area so as to discharge any residual charge in the photoreceptor material of the photoreceptive member 12. The image area of the photoreceptive member 12 is next moved in the process direction past a charging station 28 for application of a generally uniform charge to the image area. The charging station can have, for example, a DC scorotron 24 and an adjacent AC scorotron 26. The DC and AC scorotrons 24, 26 together prepare the image area for exposure by a photo source to generate an electrostatic latent image. The image area then continues to advance in the process direction to an exposure station 30.

The exposure station 30 preferably has a laser 32 emitting a modulated laser beam 34. The exposure station 30 raster scans the modulated laser beam onto the charged image area. The exposure station 30 can alternately employ LED arrays or other arrangements of photo sources to generate a light image representation that is projected onto the image area of the photoreceptive member 12. The laser beam 34 exposes a light image representation of one color component of the composite color image onto the image area to form a first electrostatic latent image. The light image representation is preferably halftone dots. The exposure of the image area forms therefore the first electrostatic latent image having a generally two-level voltage profile. The electrostatic photographic printing machine 10 and method of operation thereof have particular usefulness with regard to discharge area development wherein the toner is developed into the discharged areas of the latent image.

The laser beam 34 typically produces charge of close to CV on the photoreceptive member 12. The charge of about CV has a field generally equal to the applied fields resulting from the surface charge on the photoreceptor. Therefore, the charges transiting the photoreceptive member 12 in the vicinity of the trailing edge of the charge front, the trailing charges, experience very low electric fields. These trailing charges, responsible for the tail of the discharge curve, transit the photoreceptive member over a relatively long period due to the low electric fields. As a result, the discharge process may not be completed by the time the exposed portions of the latent image arrive at a development station 38. The degree of completeness of discharge of the exposed portions of the latent image acceptable for the electrophotographic printing machine 10 is dependent on the process tolerances and controls.

Figure 2:
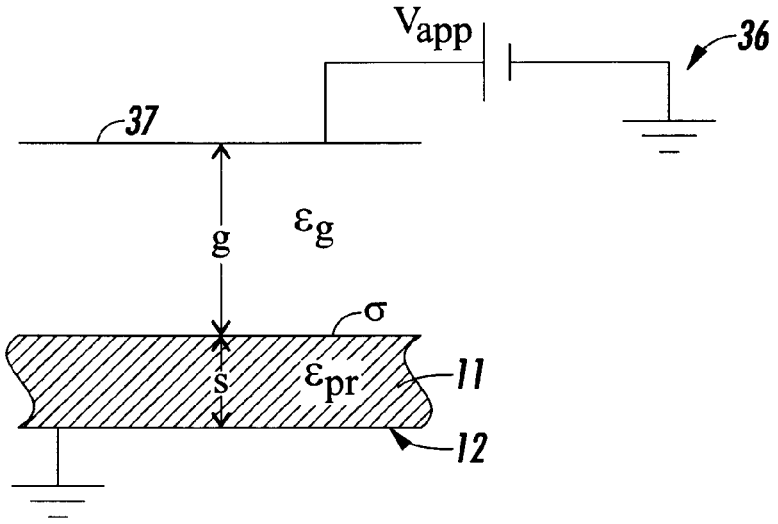
FIG. 2 is a schematic representation of the cross-section of a photoreceptive member and field applicator in accordance with the invention.
Figure 3:
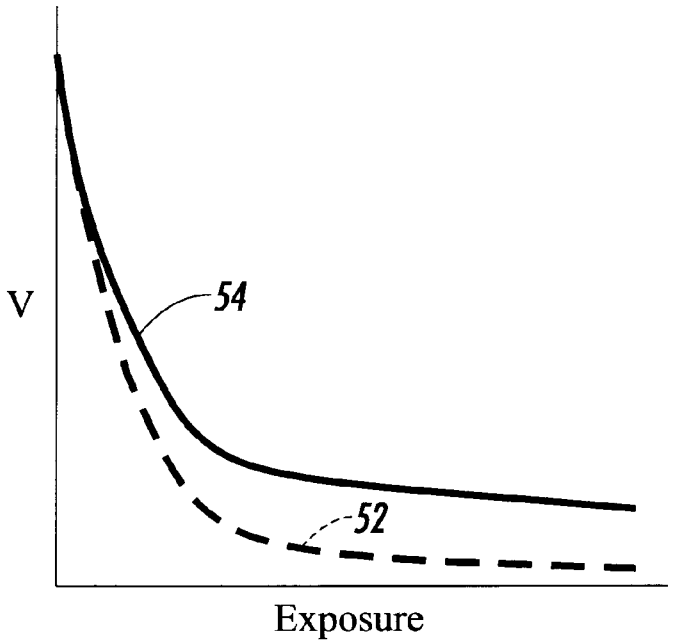
FIG. 3 is a graphical representation of the discharge curve with and without the transport-assisting field in accordance with the invention.

A field applicator 36 is positioned between the exposure station 30 and development station 38 in the process direction. In a first embodiment in accordance with the invention, the field applicator 36 has an electrode 37 positioned over the surface of the photoreceptive member 12 and oriented generally orthogonal to the process direction (see FIG. 2). The field applied to the photoreceptor by the field applicator 36 can be described as:

$$E_{pr}=(V_{PR}+\alpha V_{app})\ /s\ (1+\alpha)$$

where $$\alpha=\epsilon_g s/\epsilon_{PR} g$$

wherein the dielectric permittivity of the gap is $\epsilon_g$, the dielectric permittivities of the photoreceptor is $\epsilon_{PR}$, s is the depth of the photoreceptor layer 11, the surface charge of the photoreceptor is $\delta$ and corresponds to a voltage of VPR $=\delta s/\epsilon_{PR}$ in the absence of the electrode 37, and $V_{app}$ is the voltage applied. The analysis of the equation for typical Xerographic parameters and the consequences are discussed below. Furthermore, the electric field is applied over a length of the moving photoreceptive member 12. Therefore the time spent by a point on the photoreceptor in the electric field is t=L/v, where L is the length of the photoreceptor within the field and v is the process velocity of the photoreceptive member 12. With photoreceptor member speeds of 20 inches per second, the length of the photoreceptor within the field only needs to be about 2 cm to make the dwell time in the field of about 40 ms. This dwell time t of about 40 ms is relatively large compared to the transit time of charges in fields as low as 5 volts per micrometer in 1 millisecond. The application of the electric field to the discharge portions of the latent image results in an increased discharge rate relative to the conventional arrangement where no electric field is applied. With reference to FIG. 3, the discharge rate 52 with the assist field from the field application device 36 is substantially greater than the discharge rate 54 without the use of an assist field. Therefore, discharge can be completed before arrival of the image area at the development station 38.

In some operational environments, however, implementation of field generation by use of an electrode can be difficult to achieve due to mechanical tolerances. Mechanical tolerances can require the gap between the electrode 37 and the photoreceptive member 12 be not less than 1000 micrometers. Thus, for a typical organic photoreceptor layer 11 with s=25 micrometers and a dielectric constant of 3, the parameter a is calculated to be on the order of 0.01. Therefore, in order to create sufficient electric fields (of the order of 10 volts per micrometer) in the photoreceptive member to increase discharge, the voltage applied to the electrode 37 can be as much as 15 kilovolts. Such high electrode a potential of 15 kilovolts on the electrode 37 is impractical as it would result in air breakdown which would result in destruction of the latent image on the image area of the photoreceptive member 12.

In a further embodiment of the invention, a field applicator 36 has a bias roller 39 for application of a potential to the photoreceptive member 12. The bias roller 39 is of the type typically employed for bias charge and transfer rollers. The bias roller 39 rollingly engages the surface of the photoreceptive member 12 for application of an electric field thereto. The bias roller 39 is preferably chosen to be electrically similar to the material of the photoreceptor member 12 to reduce contact charge injection. The use of the bias roller 39 in contact with the photoreceptive member 12 results in a gap 0 in the nip width. Therefore the full electrical potential applied to the biased roller 39 is applied across the photoreceptive member 12. A DC voltage is preferably applied to the bias roller 39. The DC voltage is selected to be below the critical voltage such that the bias roller 39 does not charge the photoreceptive member 12. Operation of the bias roller 39 below the critical voltage results in application of a field to the photoreceptive member 12 without destroying the latent image and does not charge the photoreceptive member 12. The critical voltage that sets a maximum that the voltage applied is below in order to avoid charging of the photoreceptive member 12 can be determined by:

$$V_{crit}=[(312)^{1/2}+(6.2s/K_s)^{1/2}]^2\text{V},$$

where s is in micrometers and $K_s$ is the dielectric constant of the photoreceptive material.

In one example in accordance with the invention for a photoreceptive thickness of 25 micrometers, $V_{crit}$ is calculated equal to about 600 volts. The voltage applied is therefore preset below this value to avoid destroying the latent image. This voltage is large for the requirements of the system. In order to implement the preferred electric field, a bias of only 250 volts is required to produce a field of 10 volts per micrometer. A field of 10 volts per micrometer is readily sufficient to complete discharge of the photoreceptive member 12 before the image area reaches the development station 38. The bias roller 39 is preferably chosen to be electrically similar to the material of the photoreceptor member 12.

The image area is advanced to the development station 38 after application of the electric field by the field applicator 36. In discharge area development, the charged toner adheres to the discharged areas of the latent image to develop a toner image on the photoreceptive member 12.

The image area having the toner image advances to the pre-transfer station after development of the final toner layer by the fourth development station 38. The pre-transfer station has a pre-transfer lamp 47 positioned at the rear surface of the photoreceptive member 12 for discharge of the photoreceptive member. The pre-transfer station further has a pre-transfer charging device 40. The pre-transfer charging device 40 charges the toner image to improve transfer of the toner image from the photoreceptive member 12 to a substrate 50. The substrate 50 is typically paper but could be other well-known print receiving substrates or an intermediate transfer member.

The substrate 50 is placed over the pre-transfer charged toner image using a sheet feeder (not shown). The substrate 50 and image area are brought into contact to transfer the toner image from the photoreceptive member 12 to the substrate 50. A transfer corotron 56 applies positive ions onto the backside of the substrate 50, opposite the photoreceptive member 12, to attract the charged toner particles of the toner image onto the substrate 50 from the photoreceptive member 12. A detack corotron 58 then neutralizes a portion of the charge on the substrate 50. The neutralization of the charge on the substrate 50 by the detack corotron 58 assists in separation of the substrate 50 from the photoreceptive member 12. The leading edge of the substrate 50 separates from the surface of the photoreceptive member 12 as the photoreceptive member 12 moves around the curve defined by the first tension roller 16.

The substrate 50 supporting the toner image is then directed from the photoreceptive member 12 into a fuser assembly 60. The fuser assembly 60 employs a heated fuser roller 62 and a pressure roller 64 defining a fusing nip through which the substrate 50 passes. The substrate 50 is directed into the fuser nip where a combination of heat and pressure at the nip causes the composite toner image to fuse into the substrate 50 to form the final printed document. A chute (not shown) guides the document to a catch tray (not shown) for removal by an operator after fusing.

The image area of the photoreceptive member 12 then continues in the process direction and passes a preclean erase lamp 66. The pre-clean erase lamp 66 neutralizes most of the charge remaining at the image area of the photoreceptive member 12. Cleaning station 68 then removes the residual toner or debris from the image area. The cleaning station 68 preferably has blades to wipe the residual toner particles from the image area. The operation of the cleaning station 68 completes the four-cycle printing process. The electrophotographic printing machine 10 can thereafter begin the printing of a new composite toner image onto a substrate by reoperation of the pre-charge erase lamp 22 and the start of another four cycles.

While the invention has been described with reference to the structure disclosed, it is not confined to the details set forth, but is intended to cover such modifications or changes as may come within the scope of the following claims. The invention is described with discharge area development and negatively charged toner but one skilled in the art readily recognizes the applicability of other well-known developer, charge arrangements, and photoreceptor materials of an electrophotographic machine. While preferred embodiments of the foregoing invention have been set forth for purposes of illustration, the foregoing description should not be deemed to limit on the invention herein. Accordingly, various modification, adaptations and alternatives may occur to one skilled in the art without departing from the spirit and scope of the present invention.

What is claimed is:

1. A method for developing an electrostatic latent image on a charged photoreceptive member of an electrostatographic printing apparatus comprising:

exposing the photoreceptive member to discharge selected portions of the photoreceptive member, thus forming a latent image;

applying an electric field to the latent image to increase the rate of discharge of the selected portions of the photoreceptive member; and developing the latent image with toner.

2. The method of claim 1, wherein said exposing the photoreceptive member comprises applying a laser or LED to said charged photoreceptive member.

3. The method of claim 1, wherein said applying an electric field comprises contacting a biased roller to said photoreceptive member.

4. A method for developing an electrostatic latent image on a photoreceptive member of an electrostatographic printing apparatus comprising:

charging the photoreceptive member with a generally uniform first voltage;

exposing the charged photoreceptive member to form a latent image having an unexposed portion at said first voltage, and a discharged portion at a time-varying second voltage less than said first voltage, said discharged portion having a discharge rate;

applying an electric field to said latent image to increase said discharge rate of said discharged portion of said latent image; and developing said latent image.

5. The method of claim 2, wherein said developing comprises applying charged toner to said discharged portion.

6. The method of claim 5, wherein said applying an electric field comprises contacting a biased roller to said photoreceptive member.

7. A electrophotographic printing apparatus comprising:

a photoreceptive member defining an image area;

a charging device for applying a generally uniform charge to said image area;

an exposure station for forming a light image representation on said image area to form an electrostatic latent image having a charged portion and a discharged portion;

a field applicator for applying an electrical field to said latent image to assist in discharging said photoreceptive member; and a developer station for developing said latent image.

8. The electrophotographic printing apparatus of claim 7, wherein said field applicator comprises a biased roller contacting said photoreceptive member.

9. The electrophotographic printing apparatus of claim 8, wherein said biased roller is biased at $\leqq 600$ volts.

10. The electrophotographic printing apparatus of claim 8 wherein said biased roller is biased at less than about 600 volts.

11. A method for enhancing discharge of an electrostatic latent image on photoreceptive member having a pre-established discharge rate comprising:

applying an electric field to the latent image sufficient to increase the discharge rate of the photoreceptive member and insufficient to obliterate the latent image.

* * * * *